US006740126B2

(12) United States Patent
Wang et al.

(10) Patent No.: US 6,740,126 B2
(45) Date of Patent: May 25, 2004

(54) METHOD FOR THE APPLICATION OF DURABLE PRESS FINISHES TO TEXTILE COMPONENTS VIA THE USE OF HYDROPHOBIC BLEACHING PREPARATION

(75) Inventors: Jiping Wang, West Chester, OH (US); Robert William Johnston, Sharonville, OH (US)

(73) Assignee: Strike Investments, LLC, Loveland, OH (US)

( * ) Notice: Subject to any disclaimer, the term of this patent is extended or adjusted under 35 U.S.C. 154(b) by 165 days.

(21) Appl. No.: 09/784,489

(22) Filed: Feb. 15, 2001

(65) Prior Publication Data

US 2001/0054201 A1 Dec. 27, 2001

Related U.S. Application Data

(60) Provisional application No. 60/182,625, filed on Feb. 15, 2000.

(51) Int. Cl.[7] ..... D06L 3/02

(52) U.S. Cl. ..... 8/111; 8/101; 8/181; 8/185; 8/195; 510/276; 510/286; 510/302; 510/309; 510/312; 510/313; 510/287; 510/367; 510/372; 510/375

(58) Field of Search ..... 8/101, 111, 181, 8/185, 195; 510/276, 286, 302, 309, 312, 313, 287, 367, 372, 375

(56) References Cited

U.S. PATENT DOCUMENTS

| | | | | | |
|---|---|---|---|---|---|
| 3,639,096 | A | * | 2/1972 | Wright, III | 8/74 |
| 4,539,007 | A | | 9/1985 | Rösch et al. | |
| 5,527,362 | A | * | 6/1996 | Cole et al. | 8/111 |
| 5,833,719 | A | * | 11/1998 | Francois et al. | 8/111 |
| 5,840,667 | A | | 11/1998 | Milne et al. | |
| 5,885,303 | A | * | 3/1999 | Payet | 8/116.4 |
| 6,096,097 | A | * | 8/2000 | Kummeler et al. | 8/111 |
| 6,569,209 | B2 | * | 5/2003 | Wang et al. | 8/111 |

FOREIGN PATENT DOCUMENTS

| | | | |
|---|---|---|---|
| EP | 0 360 383 A2 | | 3/1990 |
| EP | 360383 | * | 3/1990 |
| EP | 0 584 710 A2 | | 3/1994 |
| GB | 1 392 981 | | 4/1972 |
| WO | WO 94/28106 | | 12/1994 |
| WO | 94/28106 | * | 12/1994 |
| WO | WO 95/21283 | | 8/1995 |

OTHER PUBLICATIONS

U. Denter et al., Peressigsäure in der Textilveredlung, Apr. 1996, 50–55.

Scarborough et al., The Use Of Tetra Acetyl Ethylene Diamine (T.A.E.D) In The Bleaching Of Mixed Fibre Blends To Improve Fibre Quality, 290–298.

* cited by examiner

*Primary Examiner*—Charles Boyer
(74) *Attorney, Agent, or Firm*—Hasse Guttag & Nesbitt; Donald E. Hasse

(57) ABSTRACT

A method for the application of durable press to textiles via the pre-treatment bleaching of a non-finished textile component followed by the application of a durable press finish is provided. The method comprises the steps of treating a non-finished textile component in an aqueous bleaching solution of hydrogen peroxide and a hydrophobic activator or hydrophobic peracid for a time sufficient to bleach the textile component followed by application of the durable press finish preferably via immersion in an aqueous solution of formaldehyde, a cross lining catalyst and a silicone elastomer forming material or a solution of alkylene urea and a crosslinking catalyst. Preferred bleach activators include the alkanoyloxybenzene sulfonates and in particular noanoyloxybenzene sulfonate. The method allows significant savings in both energy and time due to the lower bleaching temperatures possible via the present method as opposed to conventional peroxide processing.

25 Claims, No Drawings

METHOD FOR THE APPLICATION OF DURABLE PRESS FINISHES TO TEXTILE COMPONENTS VIA THE USE OF HYDROPHOBIC BLEACHING PREPARATION

CROSS REFERENCE TO RELATED APPLICATIONS

This application claims priority under 37 U.S.C. § 119(e) to U.S. Provisional Application Ser. No. 60/182,625, filed Feb. 15, 2000.

TECHNICAL FIELD

The present invention relates to the use of hydrophobic bleaching systems to prepare textiles for finishing and, more particularly, to the use of activated peroxide bleaching via hydrophobic activators or hydrophobic peracids to prepare woven or knitted fabrics, fibers or yarns for application of durable press as well as the textiles produced therefrom.

BACKGROUND OF THE INVENTION

In the textile processing of natural fibers, yarns and fabrics, a pretreatment or preparation step is typically required to properly prepare the natural materials for further use and in particular for the dyeing and/or finishing stages typically required for commercial goods. These textile treatment steps remove impurities and color bodies, either naturally existing or those added by the spinning and weaving steps to the fibers and/or fabrics.

A common pretreatment step for preparing textiles for finishing involves a bleaching step to destroy naturally occurring color bodies and is necessary for commercially acceptable consumer fabrics. Traditional textile bleaching of natural fibers has involved the use of hydrogen peroxide. Hydrogen peroxide has gained its wide acceptance due to its flexibility of use being capable in both hot and rapid or cold and long dwell bleaching processes and due to its environmental friendliness.

While hydrogen peroxide has gained wide spread acceptance in the textile industry, it is not a particularly effective bleaching agent. Hydrogen peroxide, as commercially supplied, is an extremely stable compound and as a result has only a slight bleaching effect on natural fibers. To overcome its weak activity, extremely high temperatures and/or extremely long bleaching times are required in commercial processes in addition to activation of the peroxide. That is, temperatures in excess of 95° C. are typically required. In addition, activation of the peroxide via the use of alkali, sulfuric acid, uv irradiation, hypochlorite or organic activators is also necessary with alkali being the most preferred. Not only do these drawbacks result in excessive cost associated with commercial textile peroxide bleaching, but the high temperatures and/or long contact times result in significant fiber damage and strength reduction of the resultant yarns and fabrics.

These drawbacks, in particular, fiber damage and fabric strength reduction, when combined with a durable press application are exacerbated. A number of processes are known for treating textiles to make them wrinkle-free or provide them with durable press benefits including resin or polymer treatments as well as formaldehyde crosslinking. Conventional formaldehyde durable press treatment involves saturating the textile with an aqueous solution of formaldehyde and acid catalyst followed by heat curing at high temperature to crosslink the formaldehyde to the textile. However, the combination of curing at high temperature and an acid catalyst results in an unacceptably high loss in fiber strength.

Accordingly, the combination of conventional peroxide bleaching technology with conventional durable press technology will result in unsatisfactory textile properties. Thus, the need remains for a simple, reproducible, effective and low cost process for the preparation and durable press finishing of textiles.

SUMMARY OF THE INVENTION

This need is met by the present invention wherein a method for the preparation and application of durable press to textiles is provided. Textile substrates produced from the method are also provided. The method involves the treatment of textiles using activated peroxygen bleaching via hydrophobic bleaching agents followed by application of a durable press finish. The bleaching aspect of the present invention involves the use of hydrogen peroxide and a hydrophobic bleaching agent such as an activator or a hydrophobic peracid while the durable press step involves the application of a durable press via cross-linking technology such as resins or formaldehyde. In the preferred durable press treatment of the present invention, an aqueous solution of formaldehyde, catalyst and silicone elastomer forming material is employed to saturate the textile followed by curing.

The use of a hydrophobic bleach species provides superior fabric strength and fiber damage benefits, i.e. strength retention to fibers, yarns and fabrics, in addition to significant cost reduction in the operation of the bleaching step through the use of significantly lower bleaching temperatures than conventional peroxide bleaching and much shorter processing times, particularly in batch processing.

While not wishing to be bound by theory, it is believed that in the bleaching step of the present invention, the hydrophobic bleach species of the present invention provide better absorbency on the fabrics and yarns and better "wetting" of the surface of the fibers than conventional peroxide bleaching techniques or hydrophilic activators. Hydrophobic bleach activators form the active bleaching species, peracid, on the surface of the fabric allowing a longer time on the surface of the fabric. Hydrophilic activators, meanwhile, form peracid in solution and must then undergo a fabric solution interaction which is less efficient. As a result, the hydrophobic activators of the present invention provide superior bleaching and whiteness while minimizing fiber damage and fabric strength reduction.

Again, while not wishing to be bound by theory, it is believed that in the preferred durable press step of the present invention, the unique presence of the silicone elastomer in the durable press finish provide improved fiber strength benefits versus conventional durable press methods. Thus, the combination of the hydrophobic bleaching and the durable press of the present invention, lead to a textile with superior fiber strength properties in comparison to like textiles treated via conventional technology. The textiles provided via the present method have superior whiteness in addition to strength retention as well as superior wettability.

According to a first embodiment of the present invention, a method for the treatment of non-finished textile components is provided. The method comprises the steps of providing a non-finished textile component such as a fiber, yarn or fabric, saturating the textile component with an aqueous bleaching solution comprising hydrogen peroxide and a hydrophobic bleaching agent such as an activator or a pre-formed hydrophobic peracid, and allowing the bleaching solution to remain in contact with the textile component for a period of time sufficient to bleach the textile component followed by finishing the textile component with the application of durable press. The preferred durable press application step includes treating the textile with an aqueous solution of formaldehyde, a catalyst capable of catalyzing a cross linking reaction with the textile and an effective amount of a silicone elastomer forming material and curing the treated textile to form durable press in the textile component. Alternatively preferred in the present invention is a durable press application comprising treating the textile with a solution of an alkylene urea and a catalyst capable of crosslinking the urea on the textile.

In preferred embodiments, the bleaching solution comprises hydrogen peroxide and a hydrophobic bleach activator which is selected from the group consisting of:

a) a bleach activator of the general formula:

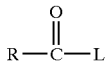

wherein R is an alkyl group having from about 5 to about 17, preferably from about 8 to about 11, carbon atoms and L is a leaving group;

b) a bleach activator of the general formula:

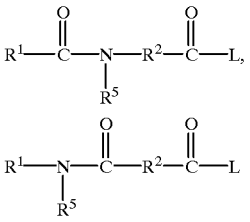

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

c) a benzoxazin-type bleach activator of the formula:

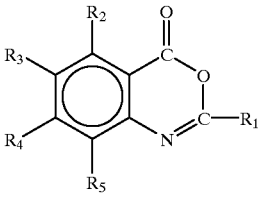

wherein $R_1$ is H, alkyl, alkaryl, aryl, arylalkyl, and wherein $R_2$, $R_3$ $R_4$, and $R_5$ may be the same or different substituents selected from H, halogen, alkyl, alkenyl, aryl, hydroxyl, alkoxyl, amino, alkylamino, —$COOR_6$, wherein $R_6$ is H or an alkyl group and carbonyl functions;

d) a N-acyl caprolactam bleach activator of the formula:

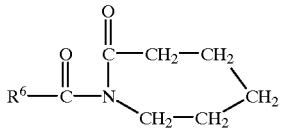

wherein $R^6$ is H or an alkyl, aryl, alkoxyaryl, or alkaryl group containing from 1 to 12 carbons; and e) mixtures of a, b, c and d with the alkanoyloxybenzenesulfonates of the formula:

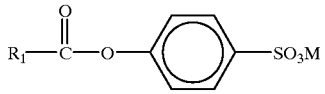

wherein $R_1$ is an alkyl group having from about 8 to 11 carbon atoms and M is a suitable cation being the most preferred hydrophobic activators.

In optional embodiments, the bleaching solution further includes an ingredient selected from the group of wetting agents, sequestering agents, stabilizing agents, de-sizing agents, scouring agents and mixtures thereof. Preferred ranges of peroxide and activator are from about 1 g/L to about 20 g/L hydrogen peroxide with a molar ratio of hydrophobic bleach activator to hydrogen peroxide of from about 1:1 to 1:50.

The textile components remain in contact with the bleaching solution at a temperature of from about 20 to about 80° C., preferably from about 50° C. to about 80° C. and for a period of time suitable for whitening the textile component which is typically at least about 15 minutes, more preferably from about 15 minutes to about 180 minutes, and even more preferably from about 30 to about 60 minutes. In preferred operations, the textile component experiences a fabric strength reduction of less than about 10% and more preferably less than about 5% due to the bleaching of the present invention. Alternatively, the textile component experiences a fluidity increase of less than about 25%.

In preferred embodiments of the durable press step the curing is a heat curing and is carried out at a temperature of from about 250° F. to about 325° F. while the textile is immersed in a treatment solution which preferably provides a solution pick up, on weight of fabric, of at least about 3% formaldehyde, at least about 1% catalyst and at least 1% silicone elastomer forming material and a preferred catalyst of magnesium chloride containing citric acid.

Accordingly, it is an object of the present invention to provide a method for the application of durable press finish to textile components such as fibers, yarns and fabrics without a significant reduction in fabric strength, and potential fiber damage common to conventional preparation processes. It is another object of the present invention to provide a method for the application of durable press finishes to textiles involving the use preparation step employing a hydrophobic bleach activator or pre-formed peracid in conjunction with hydrogen peroxide. These, and other objects, features and advantages of the present invention will be apparent from the following detailed description and the appended claims.

All percentages, ratios and proportions herein are on a 100% weight basis unless otherwise indicated. All documents cited herein are hereby incorporated by reference.

DETAILED DESCRIPTION OF THE PREFERRED EMBODIMENTS

Thus, according to the present invention, a superior textile treatment process for fibers, yarns and fabrics, both knitted and woven, and superior textile substrates is provided. The treatment process involves a two step method wherein the first step is a the preparation of a non-finished textile component such as a fiber, yarn or fabric followed by the second step of providing a durable press/wrinkle free finish to the textile. Present commercial textile preparation and finishing methods, and, in particular, textile bleaching and durable press/wrinkle free finishing methods, remain unsatisfactory due to the fiber and fabric damage of the treated textiles, high costs associated with the high temperatures necessary to drive bleaching, and the high costs due to extra equipment necessary.

The present invention provides a cost effective and superior performing alternative to conventional processing. The present invention involves the use of a hydrophobic bleaching agent such as an activator and hydrogen peroxide or a pre-formed peracid in conjunction with peroxide for the bleaching of non-finished textile components followed by the application of durable press and in particular the application of formaldehyde based durable press employing a silicone elastomer in the finish. These hydrophobic bleaching species provide superior results in the context of textile whiteness and in fabric strength retention. While conventional textile bleaching processes require high temperatures of more than 95° C. to achieve satisfactory whiteness values of more than 70 on the CIE whiteness index, the result is a degradation of the strength of the fabrics of 15% and more from the original fabric strength, the method of the present invention provides satisfactory whiteness values of more than 70 on the CIE whiteness index while delivering superior fiber strength retention by providing a fabric strength reduction of less than about 10%, more preferably less than about 5% and most preferably less than about 3% from of the original fabric strength following the bleaching step.

The method of the present invention also provides for superior fiber protection as opposed to conventional bleachings processes. Conventional textile bleaching leads to excessive fiber damage as measured by an increase in chemical degradation of more than 50% in typical applications. The method of the present invention, on the other hand, provides for chemical degradation in treated fibers of no more than 25%, preferably no more than 15% and even more preferably of no more than 10% whereby an increase in chemical degradation represents an increase in fiber damage. Accordingly, the use of the method of the present invention results in a significant reduction in fiber damage as opposed to conventional bleaching technology of peroxide at more than 95° which produces significantly higher fluidity increases. These unique achievements are accomplished due to the lower bleaching temperatures and surface activity possible through the method of the present invention.

In addition, the method of the present invention provides a significant cost advantage through the use of lower bleaching temperatures. In particular, the cost savings in both energy and time in batch type processing via the present invention are significant. Conventional batch processing involves the immersion of the non-finished fabrics in a bleaching solution and heating of the bleaching solution to the effective temperature of more than 95° C. The heating of the fabric and solution to such high temperatures involves a significant investment of both money and time for heating such large quantities. However, due to the lower processing temperatures possible via the present invention, such as from about 50 to about 70° C., the present invention requires significantly less energy and time investment for heating.

The bleaching preparation step of the present invention involves the use of a bleaching solution of hydrogen peroxide and a hydrophobic bleach activator or a pre-formed hydrophobic peracid. The hydrogen peroxide or pre-formed peracid is present in the bleaching solution of the present invention at levels of from about 1 to about 20 g/L, more preferably from about 1 to about 10 g/L and most preferably from about 1.5 to about 5 g/L. The hydrophobic activator is then employed at molar ratios of activator or peracid to peroxide of from about 1:1 to about 1:50, more preferably from about 1:2 to about 1:30 and even more preferably from about 1:5 to about 1:20. Meanwhile, the ratio of bleaching solution or liquor to the amount of fabric is from about 5:1 to 100:1, more preferably from about 5:1 to about 40:1 and most preferably from about 8:1 to about 20:1.

Particularly useful and preferred is the oombination of hydrogen peroxide and hydrophobic bleach activators, and in particular the alkanoyloxy class of bleach activators having the general formula:

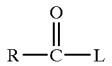

wherein R is an alkyl chain having from about 5 to about 17, preferably from about 8 to about 11 carbon atoms and L can be essentially any suitable leaving group. A leaving group is any group that is displaced from the bleaching activator as a consequence of the nucleophilic attack on the bleach activator by the perhydroxide anion. This, the perhydrolysis reaction, results in the formation of the peroxycarboxylic acid. Generally, for a group to be a suitable leaving group it must exert an electron attracting effect. It should also form a stable entity so that the rate of the back reaction is negligible. This facilitates the nucleophilic attack by the perhydroxide anion.

The L group must be sufficiently reactive for the reaction to occur within the optimum time frame (e.g., a wash cycle). However, if L is too reactive, this activator will be difficult to stabilize for use in a bleaching composition. These characteristics are generally paralleled by the pKa of the conjugate acid of the leaving group, although exceptions to this convention are known. Ordinarily, leaving groups that exhibit such behavior are those in which their conjugate acid has a pKa in the range of from about 4 to about 13, preferably from about 6 to about 11 and most preferably from about 8 to about 11. For the purposes of the present invention, L is selected from the group consisting of:

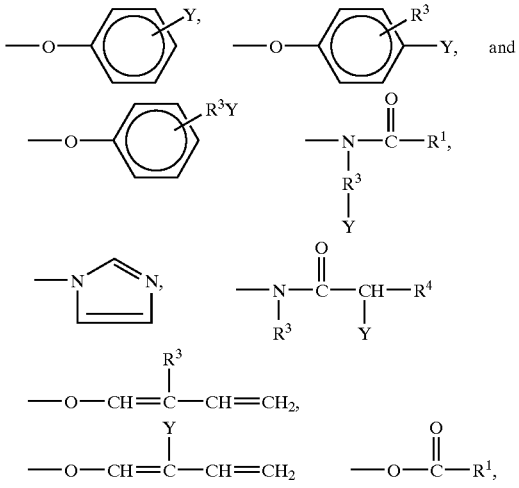

-continued

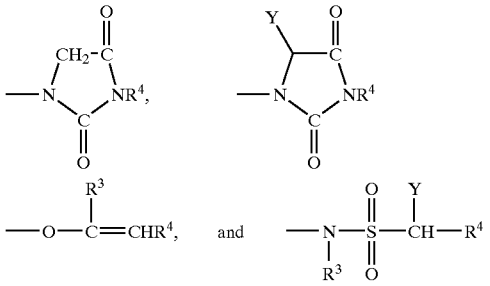

and mixtures thereof, wherein $R^1$ is an alkyl, aryl, or alkaryl group containing from about 1 to about 14 carbon atoms, $R^3$ is an alkyl chain containing from 1 to about 8 carbon atoms, $R^4$ is H or $R^3$, and Y is H or a solubilizing group.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing groups should be well dispersed in the bleaching solution in order to assist in their dissolution.

Preferred bleach activators are those of the above general formula wherein L is selected from the group consisting of:

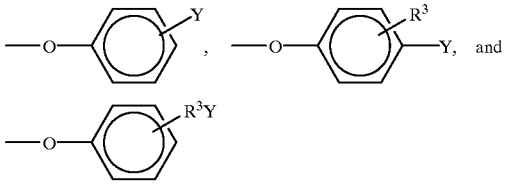

wherein $R^3$ is as defined above and Y is $—SO_3^-M^+$ or $—CO_2^-M^+$ wherein M is as defined above.

Most preferred among the bleach activators of use in the present invention, are alkanoyloxybenzenesulfonates of the formula:

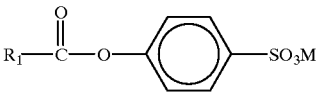

wherein $R_1$ contains from about 7 to about 12, preferably from about 8 to about 11, carbon atoms and M is a suitable cation, such as an alkali metal, ammonium, or substituted ammonium cation, with sodium and potassium being most preferred.

Highly preferred hydrophobic alkanoyloxybenzenesulfonates are selected from the group consisting of nonanoyloxybenzenesulfonate, 3,5,5-trimethylhexanoyloxybenzene-sulfonate, 2-ethylhexanoyloxybenzenesulfonate, octanoyloxybenzenesulfonate, decanoyloxybenzenesulfonate, dodecanoyloxybenzenesulfonate, and mixtures thereof.

Alternatively, amido derived bleach activators may be employed in the present invention. These activators are amide substituted compounds of the general formulas:

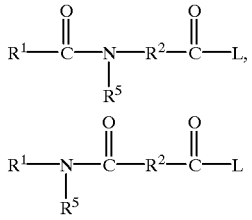

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms and L is a leaving group as defined above.

Preferred bleach activators are those of the above general formula are wherein $R^1$ is an alkyl group containing from about 6 to about 12 carbon atoms, $R^2$ contains from about 1 to about 8 carbon atoms, and $R^5$ is H or methyl. Particularly preferred bleach activators are those of the above general formulas wherein $R^1$ is an alkyl group containing from about 7 to about carbon atoms and $R^2$ contains from about 4 to about 5 carbon atoms and wherein L is selected from the group consisting of:

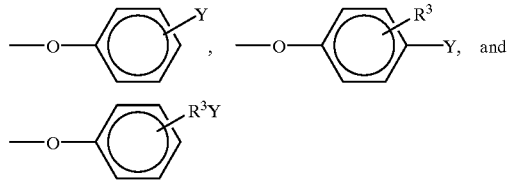

wherein $R^3$ is as defined above and Y is $—SO_3^-M$ or $—CO_2^-M^+$ wherein M is as defined above.

Another important class of bleach activators provide organic peracids as described herein by ring-opening as a consequence of the nucleophilic attack on the carbonyl carbon of the cyclic ring by the perhydroxide anion. For instance, this ring-opening reaction in caprolactam activators involves attack at the caprolactam ring carbonyl by hydrogen peroxide or its anion. Since attack of an acyl caprolactam by hydrogen peroxide or its anion occurs preferably at the exocyclic carbonyl, obtaining a significant fraction of ring-opening may require a catalyst. Another example of ring-opening bleach activators can be found in the benzoxazin type activators.

Such activator compounds of the benzoxazin-type, have the formula:

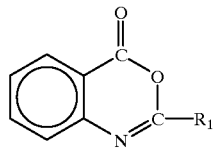

including the substituted benzoxazins of the type

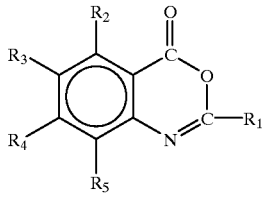

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

A preferred activator of the benzoxazin-type is:

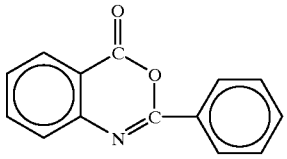

When the activators are used, optimum surface bleaching performance is obtained with washing solutions wherein the pH of such solution is between about 8.5 and 10.5 and preferably between 9.5 and 10.5 in order to facilitate the perhydrolysis reaction.

N-acyl caprolactum bleach activators may be employed in the present invention. These activators have the formula:

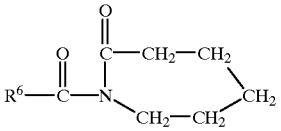

wherein $R^6$ is H or an alkyl, aryl, alkoxyaryl, or alkaryl group containing from 1 to 12 carbons. Caprolactam activators wherein the $R^6$ moiety contains at least about 6, preferably from 6 to about 12, carbon atoms provide hydrophobic bleaching which affords nucleophilic and body soil clean-up, as noted above.

Highly preferred hydrophobic N-acyl caprolactams are selected from the group consisting of benzoyl caprolactam, octanoyl caprolactam, nonanoyl caprolactam, decanoyl caprolactam, undecenoyl caprolactam, 3,5,5-trimethylhexanoyl caprolactam, and mixtures thereof.

Alternatively, a pre-formed peracid may be employed in lieu of the peroxide and activator. The pre-formed hydrophobic peracid are preferably selected from the group consisting of percarboxylic acids and salts, percarbonic acids and salts, perimidic acids and salts, peroxymonosulfuric acids and salts, and mixtures thereof, examples of which are described in U.S. Pat. No. 5,576,282 to Miracle et al.

One class of suitable organic peroxycarboxylic acids have the general formula:

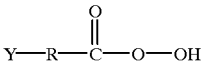

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Organic peroxyacids suitable for use in the present invention can contain either one or two peroxy groups and can be either aliphatic or aromatic. When the organic peroxycarboxylic acid is aliphatic, the unsubstituted peracid has the general formula:

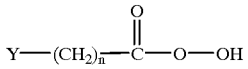

where Y can be, for example, H, $CH_3$, $CH_2Cl$, C(O)OH, or C(O)OOH; and n is an integer from 0 to 20. When the organic peroxycarboxylic acid is aromatic, the unsubstituted peracid has the general formula:

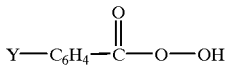

wherein Y can be, for example, hydrogen, alkyl, alkylhalogen, halogen, C(O)OH or C(O)OOH.

Typical monoperoxy acids useful herein include alkyl and aryl peroxyacids such as:

(i) peroxybenzoic acid and ring-substituted peroxybenzoic acid, e.g. peroxy-a-naphthoic acid, monoperoxyphthalic acid (magnesium salt hexahydrate), and o-carboxybenzamidoperoxyhexanoic acid (sodium salt);

(ii) aliphatic, substituted aliphatic and arylalkyl monoperoxy acids, e.g. peroxylauric acid, peroxystearic acid, N-nonanoylaminoperoxycaproic acid (NAPCA), N,N-(3-octylsuccinoyl)aminoperoxycaproic acid (SAPA) and N,N-phthaloylaminoperoxycaproic acid (PAP);

(iii) amidoperoxyacids, e.g. monononylamide of either peroxysuccinic acid (NAPSA) or of peroxyadipic acid (NAPAA).

Typical diperoxyacids useful herein include alkyl diperoxyacids and aryldiperoxyacids, such as:

(iv) 1,12-diperoxydodecanedioic acid;

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid;

(viii) 4,4'-sulfonylbisperoxybenzoic acid.

Such bleaching agents are disclosed in U.S. Pat. No. 4,483,781, Hartman, issued Nov. 20, 1984, U.S. Pat. No. 4,634,551 to Burns et al., European Patent Application 0,133,354, Banks et al. published Feb. 20, 1985, and U.S. Pat. No. 4,412,934, Chung et al. issued Nov. 1, 1983. Sources also include 6-nonylamino-6-oxoperoxycaproic acid as fully described in U.S. Pat. No. 4,634,551, issued Jan. 6, 1987 to Burns et al. Persulfate compounds such as for example OXONE, manufactured commercially by E. I. DuPont de Nemours of Wilmington, Del. can also be employed as a suitable source of peroxymonosulfuric acid.

The bleaching solutions of the present invention may also include various adjunct ingredients. Such ingredients include sequestering or chelating agents, wetting agents, pH control agents, bleach catalysts, stabilizing agents, detergents and mixtures thereof. Wetting agents are typically selected from surfactants and in particular nonionic surfactants. When employed wetting agents are typically included at levels of from about 0.1 to about 10 g/L, more preferably from about 0.1 to about 5 g/L, and more preferably 0.2 to about 1 g/L of the bath. Stabilizing agents are employed for a variety of reasons including buffering capacity, sequestering, dispersing and in addition enhancing the performance of the surfactants. Stabilizing agents are well known with both inorganic or organic species being well known and silicates and organophosphates gaining the broadest acceptance and when present are employed at levels of from about 0 to about 10 g/L, more preferably from about 0.1 to about 5 g/L and most preferably from about 0.1 to about 3 g/L of the bath. In preferred optional embodiments of the present invention, sodium hydroxide is included in the bleaching solution at levels of from about 0.5 to about 20 g/L, more preferably from about 1 to about 10 g/L and most preferably at levels of from about 1.5 to about 5 g/L.

Chelating agents may also be employed and can be selected from the group consisting of amino carboxylates, amino phosphonates, polyfunctionally-substituted aromatic chelating agents and mixtures therein, all as hereinafter defined.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzenediethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

When present, chelating agents are employed at levels of from about 0.01 to about 10 g/L, more preferably from about 0.1 to about 5 g/L, and most preferably from about 0.2 to about 2 g/L.

Bleach catalysts may also be employed in the bleaching solutions of the present invention. One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}{}_2$(u-O-)$_3$(1,4,7-trimethyl-1,4,7-triazacyclononane)$_2$-$(PF_6)_2$ ("MnTACN"), $Mn^{III}{}_2$(u-O-)$_1$(u-OAc)$_2$(1,4,7-trimethyl-1,4,7-triazacyclononane)$_2$-$(ClO_4)_2$, $Mn^{IV}{}_4$(u-O-)$_6$(1,4,7-triazacyclononane)$_4$-$(ClO_4)_2$, $Mn^{III}Mn^{IV}{}_4$(u-O-)$_1$(u-OAc)$_2$(1,4,7-trimethyl-1,4,7-triazacyclononane)$_2$-$(ClO_4)_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof. For examples of other suitable bleach catalysts herein see U.S. Pat. No. 4,246,612, U.S. Pat. No. 5,227,084 and WO 95/34628, Dec. 21, 1995, the latter relating to particular types of iron catalyst.

See also U.S. Pat. No. 5,194,416 which teaches mononuclear manganese (IV) complexes such as Mn(1,4,7-trimethyl-1,4,7-triazacyclononane$(OCH_3)_3$ $(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C-OH groups. Preferred ligands include sorbitol, iditol, dulsitol, mannitol, xylitol, arabitol, adonitol, meso-erythritol, meso-inositol, lactose, and mixtures thereof.

U.S. Pat. No. 5,114,611 teaches another useful bleach catalyst comprising a complex of transition metals, including Mn, Co, Fe, or Cu, with an non-(macro)-cyclic ligand. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co-, Cu-, Mn-, or Fe-bispyridylmethane and bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other bleach catalyst examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{II}$(u-O-)$_2Mn^{IV}N_4)^+$ and [$Bipy_2Mn^{III}$(u-O-)$_2$ $Mn^{IV}bipy_2$]-$(ClO_4)_3$.

Particularly preferred manganese catalyst for use herein are those which are fully disclosed in WO 98/23249, WO 98/39098, WO 98/39406 and WO 98/39405, the disclosures of which, are herein incorporated by reference.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt (III) catalysts having the formula:

$$Co[(NH_3)_nM'_mB'_bT'_tQ_qP_p]Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwasbing conditions such that the reduction potential for cobalt (III) to cobalt (II) under alkaline conditions is less than about 0.4 volts (preferably less than about 0.2 volts) versus a normal hydrogen electrode. Some preferred catalysts are the chloride salts having the formula $[Co(NH_3)_5Cl]Y_y$, and especially $[Co(NH_3)_5Cl]Cl_2$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.). These materials are more fully disclosed in U.S. Pat. Nos. 5,559,261, 5,597,936, 5,705,464, 5,703,030 and 5,962,386 the disclosures of which are herein incorporated by reference.

As a practical matter, and not by way of limitation, the solutions herein can be adjusted to provide on the order of at least one part per hundred million of the active bleach catalyst species in the aqueous medium, and will preferably provide from about 0.01 ppm to about 25 ppm, more preferably from about 0.05 ppm to about 10 ppm, and most preferably from about 0.1 ppm to about 5 ppm, of the bleach catalyst species in the liquor.

Also useful herein are any of the known organic bleach catalysts, oxygen transfer agents or precursors therefor. These include the compounds themselves and/or their precursors, for example any suitable ketone for production of dioxiranes and/or any of the hetero-atom containing analogs of dioxirane precursors or dioxiranes, such as sulfonimines $R^1R^2C{=}NSO_2R^3$, see EP 446 982 A, published 1991 and sulfonyloxaziridines, for example:

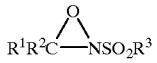

see EP 446,981 A, published 1991. Preferred examples of such materials include hydrophilic or hydrophobic ketones, used especially in conjunction with monoperoxysulfates to produce dioxiranes in situ, and/or the imines described in U.S. Pat. No. 5,576,282 and references described therein. Oxygen bleaches preferably used in conjunction with such oxygen transfer agents or precursors include percarboxylic acids and salts, percarbonic acids and salts, peroxymonosulfuric acid and salts, and mixtures thereof. See also U.S. Pat. No. 5,360,568; U.S. 5,360,569; and U.S. 5,370,826. In a highly preferred embodiment, the invention relates to a detergent composition which incorporates a transition-metal bleach catalyst in accordance with the invention, and organic bleach catalyst such as one named hereinabove.

The method of the present invention involves in the first or bleaching step providing a non-finished textile component into the bleaching solution as described. The textile component may comprise fibers, yarns and fabrics including wovens, nonwovens and knits. By non-finished, it is intended that the textile component be a material that has not been dyed, printed, or otherwise provided a finishing step such as durable press coatings. Of course, one of ordinary skill in the art will recognize that the textile component of the present invention are those that have not been passed through a garment or other manufacturing process involving cutting and sewing of the material.

One of ordinary skill in the art will recognize that the process conditions to be used for bleaching in the present invention may be selected so as to match a particular equipment or a particular type of process which it is desirable to use. For example, while the textile components preferably remain in contact with the treatment solution at a temperature of from about 20 to about 80° C., preferably from about 50° C. to about 80° C. and for a period of time suitable for treating the textile component which is at least about 15 minutes more preferably from about 30 minutes to about 180 minutes, preferably from about 30 to about 120 minutes and most preferably from about 30 to about 90 minutes. Of course, one of ordinary skill in the art will recognize that the reaction conditions such as time and temperature will vary depending upon the equipment employed and the fabrics treated.

The present process may be employed with most any natural material including cellulosics such as cotton, linen and regenerated cellulosics such as rayon and lyocell. Both 100% natural fibers, yarns and fabrics may be employed or blends with synthetic materials may be employed as well. For the purposes of the present invention, natural fibers may include cellulosics as described herein, wool both pure and blends, silks, sisal, flax and jute.

The method of the present invention may include the further preparation steps of singeing, de-sizing, scouring, and mercerization in conjunction with the bleaching step. These steps may be performed in various combinations and orders and one of ordinary skill in the art will recognize that varying combinations are possible. The de-sizing step of the present invention involves the removal of sizing agents such as starch and polyvinyl alcohol added to fibers during weaving of yarns. The de-sizing step involves the use of an aqueous solution of amylase enzymes and typically wetting agents and salts and soaking or contacting the fabrics with the enzymatic solution of a time sufficient to remove the sizing agents.

The scouring step of the present invention involves the removal of natural or synthetic impurities from the textiles such as waxes and oils. The scouring step involves the use of an aqueous alkaline bath, typically sodium hydroxide at elevated temperatures. Optional ingredients in the alkaline bath include wetting agents and chelating agents.

The mercerization step of the present invention involves the application of high concentrations of alkali such as sodium hydroxide in conjunction with stretching and pulling of the textiles to restore fiber strength and improve luster while singeing involves passing the textiles over an open flame to remove loose fibers or strands. De-sizing, scouring, mercerization and singeing are well known to one of ordinary skill in the art and will be well recognized and within the level of skill of the artisan.

Of course the process of the present invention includes in the preferred applications a washing step or series of washing steps following the method of the present invention. Washing of treated textiles is well known and within the level of skill of the artisan. Washing stages will be typically present after each of the de-sizing, scouring and mercerization step when present as well as after the bleaching step of the present invention. In addition, the bleaching and de-sizing scouring or mercerization steps when present may in preferred embodiments include a wet-out or pre-wetting step to ensure even or uniform wettness in the textile component.

The method of the present invention provides superior wettability to textile components treated via the method. Wettability of the textiles is important to any dyeing and finishing of the textiles. Wettability leads to superior penetration of the textile by the dye or finish agents and a superior dye and/or finishing result. Accordingly, the wettability of the textile is an indication of how effective the treatment process has been. Higher wettability means a more effective and superior treatment process, i.e. a shorter period of time for wetting. Conventional textile peroxygen bleaching has provided acceptable wetting profiles only at temperature in excess of 95° C. while lower temperature bleaching (70° C.) results in wettability profiles more than about 40%. However, the process of the present invention provides fabrics that have a increase in the wettability index of less than about 10% preferably less than about 5% where the wettability index is defined as:

$$\frac{(\text{wettability at } 70^\circ\text{ C.}) - (\text{wettability at } 95^\circ\text{ C.})}{(\text{wettability at } 95^\circ\text{ C.})}$$

in percent.

For purposes of the present invention, fiber damage based on fluidity is measured via AATCC test method 82-1996 involving the dispersion of the fibers in cupriethylene diamine (CP). A representative sample of fibers of about 1.5 mm is cut and dissolved in CP as defined by the equation CP=120×sample weight×0.98 in a specimen bottle with several glass balls, placed under nitrogen and dissolved by shaking for approximately 2 hours. Additional CP is added as defined by the equation CP=80×sample weight×0.98 and additional shaking under nitrogen for three hours. The solution is placed under constant stirring to prevent separation of the dispersion. The solution is then measured in a calibrated Oswald Canon Fenske viscometer in a constant temperature bath of 25° C. to determine the efflux time. Fluidity is then calculated from the formula F=100/ctd, where c=viscometer constant, t=efflux time and d=density of the solution 1.052.

The non-finished and prepared textile is then provided to a finishing step wherein a durable press finish is applied. The durable press finish of the present invention may include any of the known durable press finishes as the superior preparation step herein provides a synergistic benefit of reduction of fabric damage and fiber degration with most all durable press finishes.

Durable press systems for use herein include the crosslinking agents such as formaldehyde, urea-formaldehyde and melamine-formaldehyde. Additional crosslinking agents include the alkylene ureas such as 1,3 dimethylolethylene urea (DMEU), 1,3 dimethylolpropylene urea (DMPU) and 1,3 dimethylol-4,5 dihydroxyethylene urea (DMDHEU). Additional crosslinking agents include the non-formaldehyde ureas such as 1,3 dimethyl-4,5 dihydroxyethylene urea (DMeDHEU), unsaturated polycarboxylic acids such as 1,2,3,4-butanetetra-carboxylic acid (BTCA).

Application of durable press finishes typically include the crosslinking agent in conjunction with a curing catalyst, an optional softener and an optional lubricant. Curing catalysts include mineral acids, organic acids or latent acids such as ammonium, amine or metal salts. Magnesium chloride, fluorosilicic acid, aluminum chloride and zinc nitrate either individually or in combination with organic acids such as citric may be employed as well as the carbamates with methyl, ethyl, isopropyl, isobutyl, hydroxyethyl and methoxyethyl carbamate being the most common.

The preferred formaldehyde based durable press finish application of the present invention is described in U.S. Pat. No. 5,885,303, the disclosure of which is hereby incorporated by reference. The application involves treating the textile with an aqueous solution of formaldehyde and a catalyst capable of catalyzing the cross linking reaction between the formaldehyde and the surface of the textile in the presence of a material that will provide a silicone elastomer to the finish on the textile. Following the treatment with the aqueous solution, the textile is cured to provide the durable press finish to the textile. The curing of the treated textile may be accomplished with any known curing method as known in the art, but is preferably higher temperature heat curing.

Any known material which will provide a silicone elastomer on the surface of the textile may be used in the present invention including pre-formed silicone elastomers and silicone elastomer forming materials. Silicone elastomers are well known materials which are formed from a backbone repeating unit of silicon and oxygen with optional modification groups such as organic substituents attached to the silicon atoms and may be represented by the general formula:

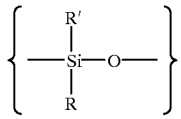

wherein the groups R and R' may be the same or different and includes, for example, lower alkyl, such as methyl, ethyl, propyl, phenyl or any of these groups substituted by hydroxy groups, fluoride atoms, or amino groups.

The materials used to provide the silicone elastomer in the finish in the present invention may be made by conventional means and are readily available from a variety of sources include GE Silicones, Sedgefield Specialties and other chemical suppliers.

The elastomers in the finish are typically high molecular weight materials generally formed of dimethyl silicone monomers formed in a linear chain. The typically available in an un-reacted form with or without a catalyst to facilitate crosslinking. The crosslinked elastomer on the textile improves the durability of the textile by producing large molecules on the textile. The silicone elastomer of the present invention provides superior strength properties to the finished textile as opposed to conventional silicone oil technology which do not provide tensile strength benefits. Optionally a reactive silicone may be employed where reactive groups capable of reacting with the substrate are incorporated into the dimethly silicone polymer.

The aqueous system of formaldehyde, an acid catalyst, material capable of providing a silicone elastomer in the finish and optionally a wetting agent is provided on the textile, preferably to ensure a moisture content of more than 20% by weight on fabric. Conventional application technology involves the use of a padding technique which comprising running the fabric through the aqueous solution which is then passed through squeezing rollers to provide a wet pick up of about 66%. Of course, one of ordinary skill in the art will recognize that the concentration of reactants in the aqueous solution may be adjusted to provide the desired amount of reactants on the weight of fabric (OWF).

Following treatment of the textiles, the formaldehyde of the preferred finish must be cured. Preferred is a high temperature heat curing via which the treated textile is passed through a curing chamber operating at a temperature of from about 250° F. to about 350° F. The process of the present invention may be operated continuously on commercial scale speeds of from about 1 to about 200 yards per minute.

The concentration of ingredients in the aqueous solution of course may be varied depending upon the textile treated. For instance, textile containing rayon fibers will require higher levels of formaldehyde than textiles containing cotton fibers who in turn require more than textiles blended with synthetic fibers such as polyester, acrylic, polyolefins, polyvinyl chloride and polyvinylidene chloride. The levels of formaldehyde in the aqueous solution will range from about 0.5% to about 20% on weight of fabric while the levels of catalyst will range from about 0.1% to about 5% on weight of fabric and silicone elastomer providing material will range from about 0.1% to about 5% as well.

The catalyst employed in the present invention includes those conventionally known for formaldehyde finishing such as fluorosilicic acid, magnesium chloride spiked with citric acid or a similar catalyst containing aluminum or magnesium chloride. In addition, an optional nonionic wetting agent to thoroughly wet the fibers in the treated textiles may be employed in the method of the present invention in levels of around 0.1% on weight of fabric. Conventional and well-known wetting agents may be employed such as for example the alkyl aryl polyether alcohol such as Triton X-100.

Without wishing to be bound by theory, it is believed that during the crosslinking reaction at the curing stage, moisture is given up from the fabric as the crosslinking occurs, resulting in a decrease in the moisture content of the fabric. In fabrics having a moisture content of less than 20%, the effectiveness of the treatment is reduced. Thus, it is preferred in the present invention to employ high moisture levels greater than 20%, more preferably greater than 30% to optimize the treatment.

What is claimed is:

1. A method for the treatment of a non-finished textile component comprising the steps of providing a non-finished textile component, saturating said textile component with an aqueous hydrophobic bleaching solution comprising hydrogen peroxide and a hydrophobic bleach activator or hydrophobic peracid, and allowing said bleaching solution to remain in contact with said textile component for a period of time sufficient to bleach said textile component followed by finishing said textile component to provide durable press to said textile component.

2. The method as claimed in claim 1 wherein said step of providing durable press comprises treating the textile with a urea based crosslinking agent.

3. The method as claimed in claim 2 wherein said urea based crosslinking agent is 1,3 dimethylol-4,5 dihydroxyethylene urea.

4. The method as claimed in claim 1 wherein said step of providing durable press comprises treating the textile with an aqueous solution of formaldehyde, a catalyst capable of catalyzing a cross linking reaction with the textile and an effective amount of a silicone elastomer forming material, and curing said treated textile to provide durable press to said textile component.

5. The method as claimed in claim 1 wherein said bleaching solution comprises hydrogen peroxide and a hydrophobic bleach activator selected from the group consisting of:

a) a bleach activator of the general formula:

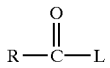

wherein R is an alkyl chain having from about 6 to about 18 carbon atoms and L is a leaving group;

b) a bleach activator of the general formula:

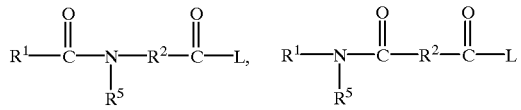

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

c) a benzoxazin-type bleach activator of the formula:

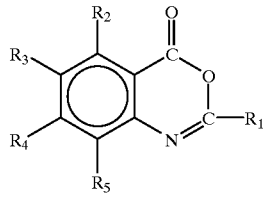

wherein $R_1$ is H, alkyl, alkaryl, aryl, or arylalkyl, and wherein $R_2$, $R_3$, $R_4$, and $R_5$ may be the same or different substituents selected from the group consisting of H, halogen, alkyl, alkenyl, aryl, hydroxyl, alkoxyl, amino, alkylamino, —$COOR_6$, wherein $R_6$ is H or an alkyl group, and carbonyl;

d) a N-acyl caprolactam bleach activator of the formula:

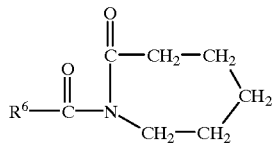

wherein $R^6$ is liar an alkyl, aryl, alkoxyaryl, or alkaryl group containing from 1 to 12 carbons; and e) mixtures of a, b, c and d.

6. The method as claimed in claim 5 wherein said hydrophobic bleach activator is a bleach activator selected from the general formula:

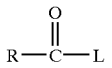

wherein R is an alkyl chain having from about 7 to about 12 carbon atoms and L is a leaving group, the conjugate acid of which has a pKa prom about 4 to about 13.

7. The method as claimed in claim 6 wherein said bleach activator is an alkanoyloxybenzenesulfonate of the formula:

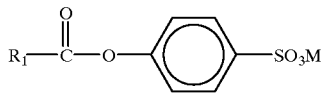

wherein $R_1$ is an alkyl group having from about 8 to about 11 carbon atoms and M is a suitable cation.

8. The method as claimed in claim 1 wherein said bleaching solution further includes an ingredient selected from the group consisting of wetting agents, sequestering agents, stabilizing agents, desizing agents, scouring agents and mixtures thereof.

9. The method as claimed in claim 5 wherein said bleaching solution contains from about 1 to about 20 g/L of hydrogen peroxide.

10. The method as claimed in claim 5 wherein the molar ratio of hydrophobic bleach activator to hydrogen peroxide in said bleaching solution ranges from about 1:1 to about 1:50.

11. The method an claimed in claim 1 wherein said textile component remains in contact with said bleaching solution for from about 15 to about 180 minutes.

12. The method as claimed in claim 11 wherein said bleaching solution is at a temperature of from about 20 to about 90° C.

13. The method as claimed in claim 10 wherein said bleaching solutions is at a temperature of from about 50 to about 80° C. and said textile component remains in contact with said bleaching solution for from about 30 to about 60 minutes.

14. The method as claimed in claim 1 wherein said bleaching solution further comprises from about 0.5 to about 20 g/L of sodium hydroxide.

15. The method as claimed in claim 12 wherein the ratio of said bleaching solution to said textile component is from about 5:1 to about 100:1 in a batch process.

16. The method as claimed in claim 1 wherein said textile component experiences a fabric strength reduction of less than about 10% during said method.

17. The method as claimed in claim 14 wherein said treated textile component experiences a fluidity increase of lass than about 25%.

18. The method as claimed in claim 1 further comprising the step of de-sizing said non-finished textile component prior to contact with said bleaching solution.

19. The method as claimed in claim 1 further comprising the step of scouring said non-finished textile component prior to contact with said bleaching solution.

20. The method as claimed in claim 19 further comprising the step of dc-sizing and said non-finished textile component prior to contact with said bleaching solution.

21. The method as claimed in claim 4 wherein said curing step is a beat curing and said heat curing is carried out at a temperature of from about 250° F. to about 325° F.

22. The method as claimed in claim 4 wherein said textile is immersed in said treatment solution to provide a pick up, on weight of fabric, of at least about 3% formaldehyde, at least about 1% catalyst and at least 1% silicone elastomer forming material.

23. The method as claimed in claim 4 wherein said catalyst comprises magnesium chloride and citric acid.

24. A product produced by the process of claim 1.

25. A product produced by the process of claim 4.

* * * * *

UNITED STATES PATENT AND TRADEMARK OFFICE

CERTIFICATE OF CORRECTION

PATENT NO. : 6,740,126 B2
DATED : May 25, 2004
INVENTOR(S) : Jipang Wang et al.

It is certified that error appears in the above-identified patent and that said Letters Patent is hereby corrected as shown below:

Column 18,
Line 62, delete the word “liar” and insert -- H or --.

Column 19,
Line 13, delete the word “lass” and insert -- less --.
Line 26, delete the word “beat” and insert -- heat --.

Signed and Sealed this

Sixteenth Day of November, 2004

JON W. DUDAS
*Director of the United States Patent and Trademark Office*